US009808962B2

(12) United States Patent
Moog et al.

(10) Patent No.: US 9,808,962 B2
(45) Date of Patent: Nov. 7, 2017

(54) TILE CUTTER

(71) Applicant: WOLFCRAFT GMBH, Kempenich (DE)

(72) Inventors: Christopher Moog, Wirges (DE); Hans-Peter Radermacher, Weibern (DE)

(73) Assignee: WOLFCRAFT GMBH, Kempenich (DE)

( * ) Notice: Subject to any disclaimer, the term of this patent is extended or adjusted under 35 U.S.C. 154(b) by 44 days.

(21) Appl. No.: 14/780,875

(22) PCT Filed: Mar. 27, 2014

(86) PCT No.: PCT/EP2014/056171

§ 371 (c)(1),
(2) Date: Sep. 28, 2015

(87) PCT Pub. No.: WO2014/154811

PCT Pub. Date: Oct. 2, 2014

(65) Prior Publication Data

US 2016/0052170 A1 Feb. 25, 2016

(30) Foreign Application Priority Data

Mar. 28, 2013 (DE) ..... 10 2013 103 193

(51) Int. Cl.
*B28D 1/22* (2006.01)

(52) U.S. Cl.
CPC ..... *B28D 1/225* (2013.01)

(58) Field of Classification Search
CPC ..... B28D 1/225; Y10T 225/325
USPC ..... 125/23.02, 13.01, 13.03; 225/103
See application file for complete search history.

(56) References Cited

U.S. PATENT DOCUMENTS

| | | | | |
|---|---|---|---|---|
| 1,873,721 | A | 8/1932 | Postley | |
| 4,770,156 | A * | 9/1988 | Boada Sucarrats .... | B28D 1/225 125/23.01 |
| 4,922,886 | A * | 5/1990 | Hepworth ..... | B28D 1/225 125/23.01 |
| 5,480,081 | A * | 1/1996 | Wilson ..... | B28D 1/225 125/23.02 |
| 2008/0115643 | A1 * | 5/2008 | Hwang ..... | B28D 1/225 83/453 |

FOREIGN PATENT DOCUMENTS

| | | | |
|---|---|---|---|
| DE | 1235792 | B | 3/1967 |
| DE | 102012101773 | A1 | 11/2012 |
| FR | 2490541 | A1 | 3/1982 |
| GB | 932640 | A | 7/1963 |

* cited by examiner

*Primary Examiner* — Larry E Waggle, Jr.
*Assistant Examiner* — Henry Hong
(74) *Attorney, Agent, or Firm* — Lucas & Mercanti, LLP; Klaus P. Stoffel

(57) ABSTRACT

A tile cutter having a base frame with a base plate and a guide which is disposed above the base plate and along which a slide carrying a cutting tool is displaceable in order to produce a score on the surface of a tile resting on the base plate, and having a breaker jaw device which is gear-coupled to the slide and is lowered onto the surface of the tile in the end phase of the displacement of the slide in order to break the tile along the score. The breaker jaw device and the slide interact with one another via a control flank arrangement in order to lower the breaker jaw device.

11 Claims, 11 Drawing Sheets

1
2
2
2
2
3
3
4
6
7
7
8
8
9
9
10
11
11
13
13
14
17
20
23
24
25
27
28
28
IV
IV
VII
VII 1
2
3
4
5
6
7
8
9
11
12
13
14
15
17
18
19
22
23
24
25
26
27
31
35

4
24
36
35
29
34
30
37
22
33
31
32
9
5
27
3
8
7
6
17
16
13
11
18
19
25
14
15
15

1
3
23
4
35
24
22
22
6
13
18
11
19
12
9
8
7
5
10
26
27
17
15
15
2
26
25
2
14

TILE CUTTER

The present application is a 371 of international application PCT/EP2014/056171, filed Mar. 27, 2014, which claims priority of DE 10 2013 103 193.5, filed Mar. 28, 2013, the priority of these applications is hereby claimed and these applications are incorporated herein by reference.

BACKGROUND OF THE INVENTION

The invention relates to a tile cutter having a base frame with a base plate and a guide which is arranged above the base plate and along which a slide carrying a cutting tool is displaceable in order to produce a score on the surface of a tile resting on the base plate, and having a breaker jaw device which is gear-coupled to the slide and is lowered onto the surface of the tile in the end phase of the displacement of the slide in order to break the tile along the score.

GB 932,640 and DE 12 35 792 describe a tile cutter having a base plate and a guide which is arranged above the base plate and along which a slide is displaceable which carries a cutting tool formed as a cutting wheel. The slide is connected by means of a rod to a lever which is arranged stationarily and pivotably on the base frame. By pivoting the lever, the slide slides along the guide. A score is cut into a tile resting on the base plate. In the end phase of the pivoting of the lever, a breaker jaw device is lowered which has a lever arrangement that is pivotably secured to the base frame. At the end of the lever arrangement there are two breaker jaws, each of which applies pressure from above on one side of the score onto the surface of the tile in order to break it along the score.

DE 10 2012 101 773 A1 describes a tile cutter, wherein the breaker jaw device is secured to the slide. By pivoting a lever which is secured to the slide, the breaker jaw device is lowered in order to break the tile, which was provided in advance with a score, along said score.

SUMMARY OF THE INVENTION

It is an object of the invention to improve the generic tile cutter in a manner advantageous for use. The object is achieved by the invention specified in the claims.

First and foremost it is proposed that the breaker jaw device and the slide interact via a control flank arrangement. The control flank arrangement preferably has a control flank. This control flank interacts with a control member of the slide in order to lower the breaker jaw device. In a preferred refinement of the invention, the control flank is formed by a control chamfer. This control chamfer is preferably provided by the breaker jaw device. The control member, which is preferably associated with the slide, can slide along the control chamfer in order to lower the breaker jaw device. However, it is also conceivable to associate the control chamfer with the slide and the control member with the breaker jaw device. The control member is preferably formed by a pair of rollers. The breaker jaw device can have two breaker jaws which are secured to the base frame to be movable substantially only transverse to the displacement of the slide. Each of the two breaker jaws can have a control flank, thus, in particular a control chamfer. The lever arrangement is secured to the base frame in such a manner that the control member acts on the control flank only if a complete score has already been created in the surface of the tile by means of the cutting tool. For this purpose, the breaker jaws can be located on a lever arrangement that is pivotably secured to the base frame, wherein the lever arrangement can have two lever arms that run parallel to one another. The two lever arms are in particular secured to a support of the guide so as to be pivotable about a pivot axis. Breaker jaws, which are in particular wedge-shaped, are located at each of the free ends of the lever arms. A roller can roll in each case along the inclined surface of the breaker jaws facing towards the guide in order to lower the breaker jaw so that the lower side thereof can exert a breaking force against the surface of the tile to be broken. A gap, through which the cutting tool can pass, can be located between the breaker jaws. To ensure that the lowering movement of the breaker jaws takes place only after the score has been created completely in the surface of the tile, the cutting tool is disposed upstream of the control member with respect to the cutting direction of the slide. The control member abuts against the control flank only after the cutting tool is passed completely through the gap. In a refinement of the invention it is provided that the length of the lever arrangement is adjustable. This results in the fact that the distance of the breaker jaws is adjustable with respect to a stop, against which the tile to be cut can be placed. It is particularly advantageous for cutting of diagonal cuts if the position of the breaker jaws is adjustable along the guide. The guide is preferably formed by two rails running parallel to one another. The rails extend equally spaced, thus in parallel extent with respect to the base plate. A breaking rib can protrude from the base plate towards the guide, which breaking rib runs below the cutting tool in the displacement direction so that the breaker jaws are disposed in each case on one side of the rib. Each breaker jaw can be located at a lever arm that is associated with the breaker jaw. The two lever arms can be connected to one another with a crossbar. Two crossbars can be provided which connect lever arms that run parallel to one another. The lever arms can be made from steel and can in particular be manufactured from stampings. For varying the length, the two lever arms can each have a longitudinal slot with locking recesses protruding transversely therefrom. A portion of the pivot pin can be accommodated in the locking recess so that the distance of the breaker jaws from the pivot pin is adjustable.

An exemplary embodiment is explained below with reference to the accompanying drawings. In the figures:

BRIEF DESCRIPTION OF THE DRAWING

FIG. 7 shows an illustration according to FIG. 6, but with the slide cut open;

DETAILED DESCRIPTION OF THE INVENTION

Figure 1:
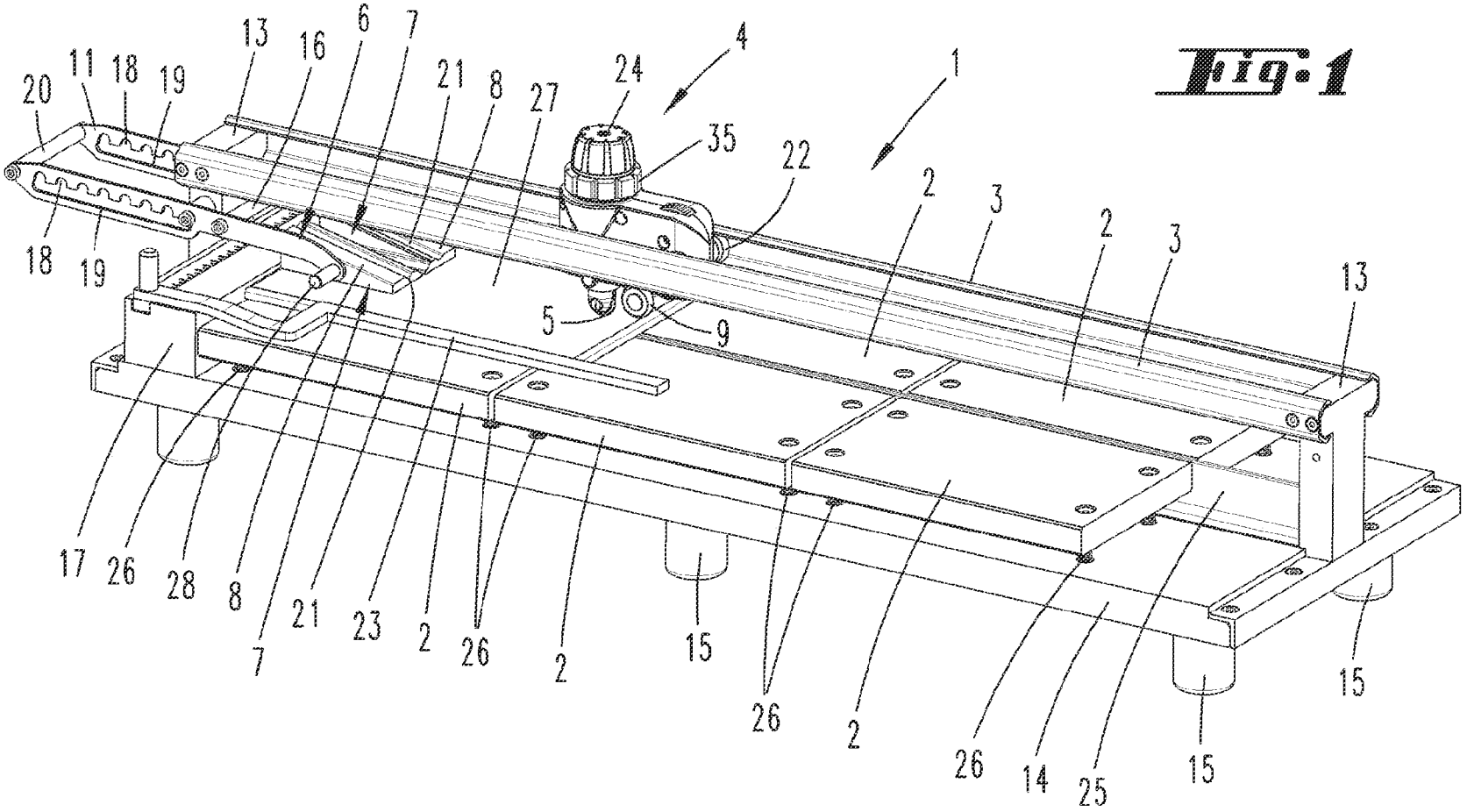
FIG. 1 shows a perspective illustration of the exemplary embodiment, a breaker jaw device being in a position in which the tile to be cut rests against a transverse stop.
Figure 2:
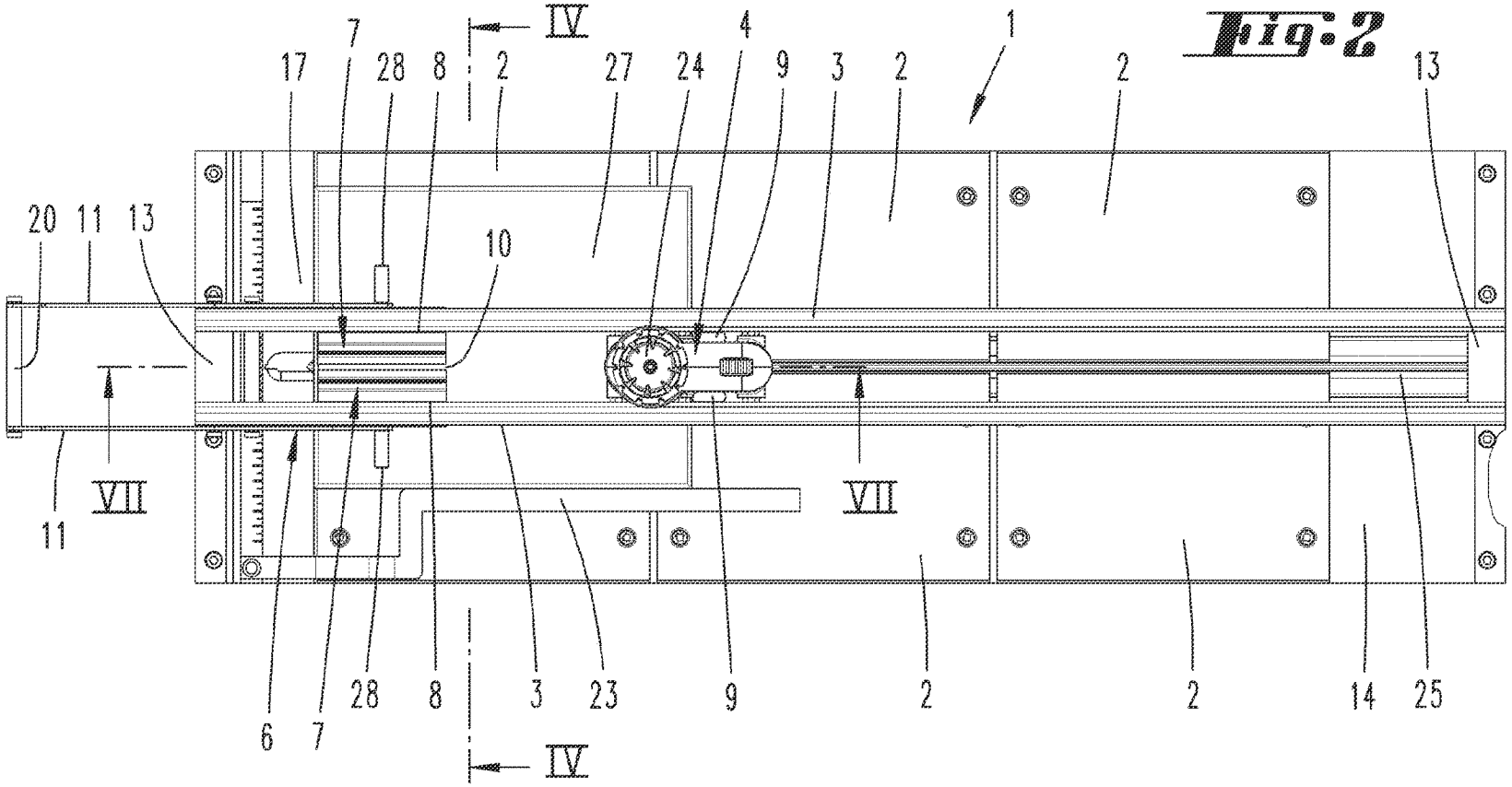
FIG. 2 shows a plan view of the exemplary embodiment.
Figure 3:
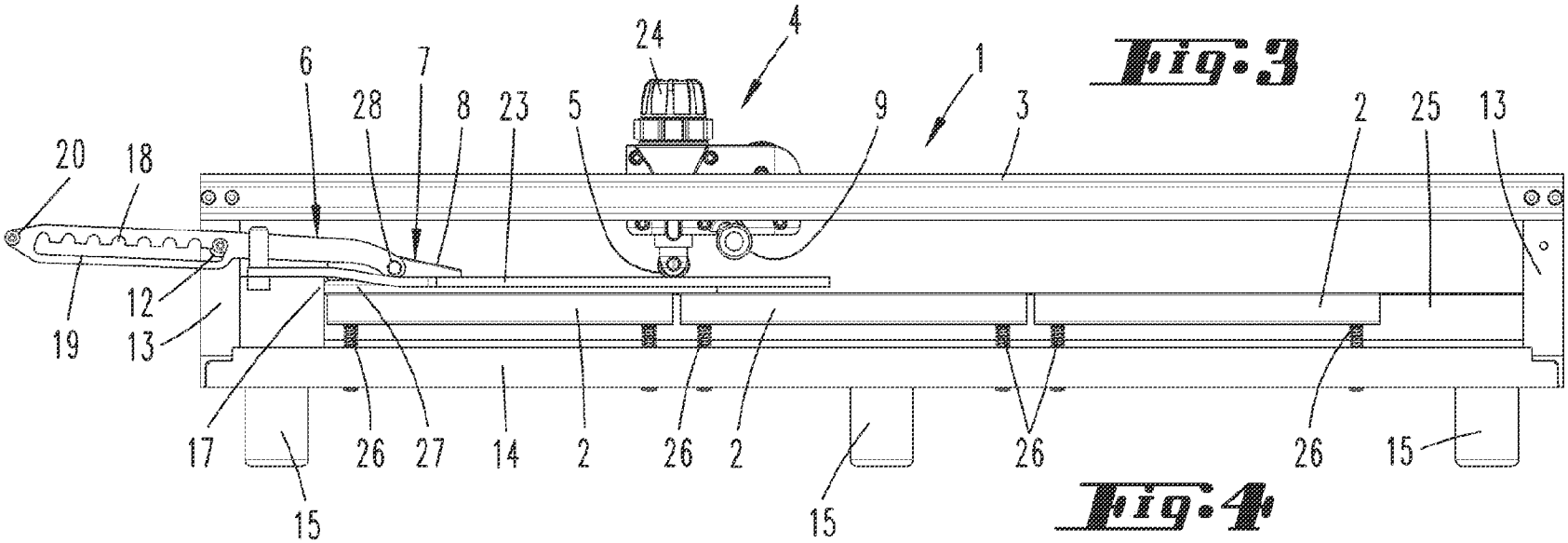
FIG. 3 shows a side view of the exemplary embodiment.
Figure 4:
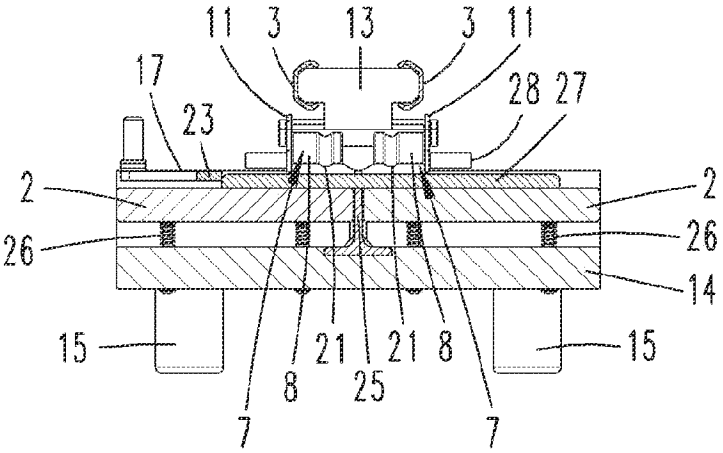
FIG. 4 shows a section according to the line IV-IV in FIG. 2.
Figure 5:
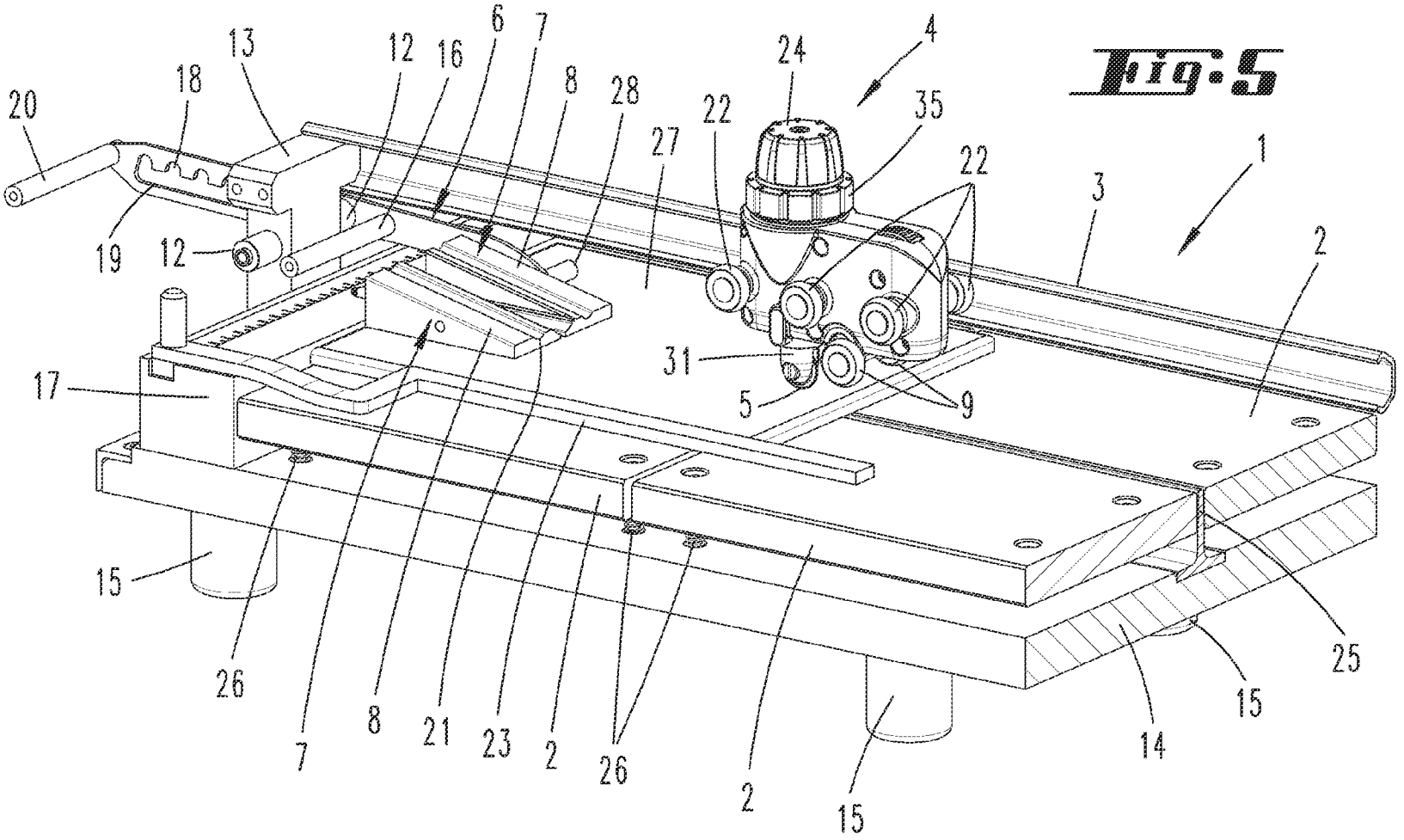
FIG. 5 shows a perspective illustration according to FIG. 1, but in the region of the breaker jaw device 6, enlarged and with the guide rail 3 removed.
Figure 6:
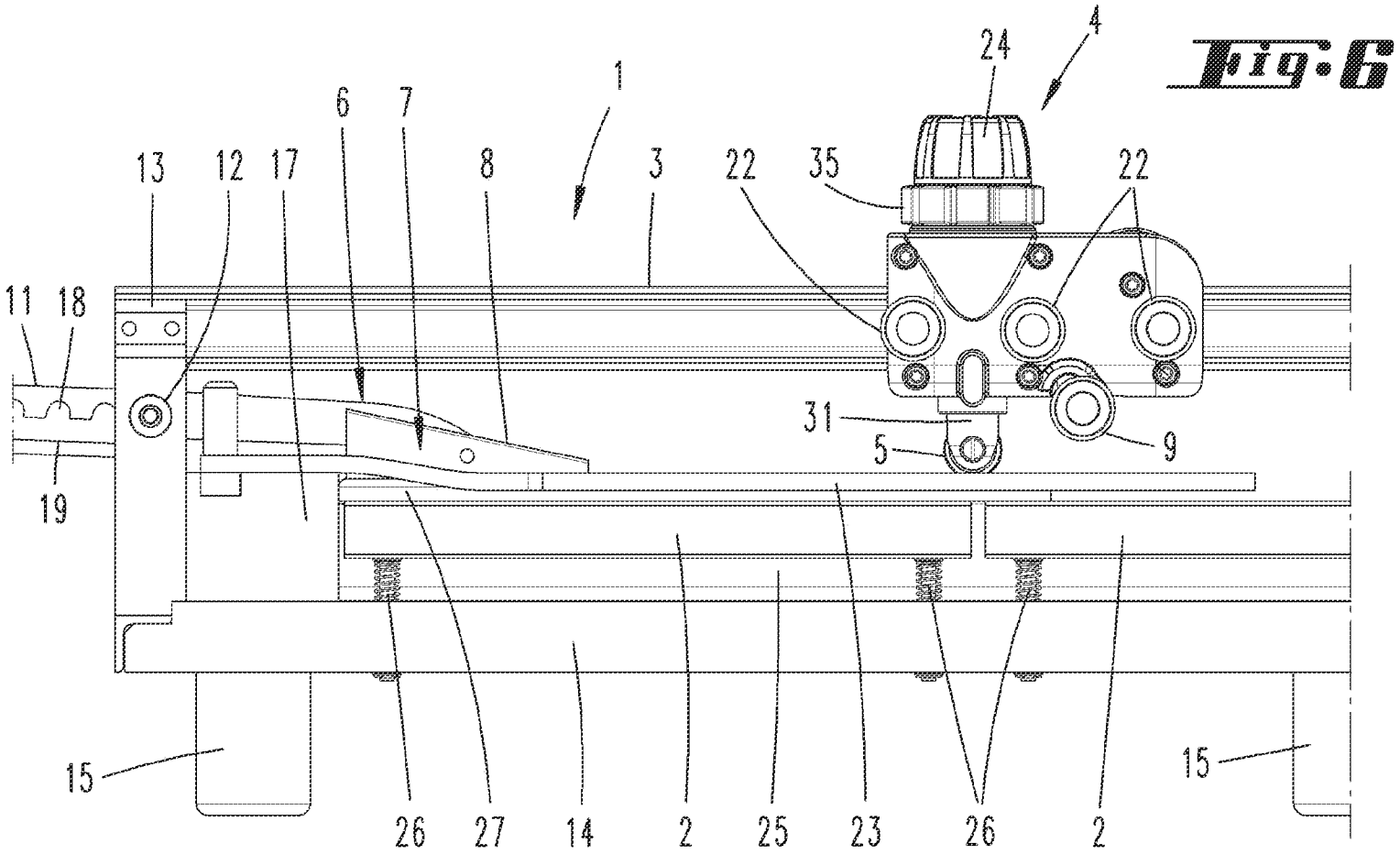
FIG. 6 shows an enlarged side view, likewise with the guide removed.
Figure 1:
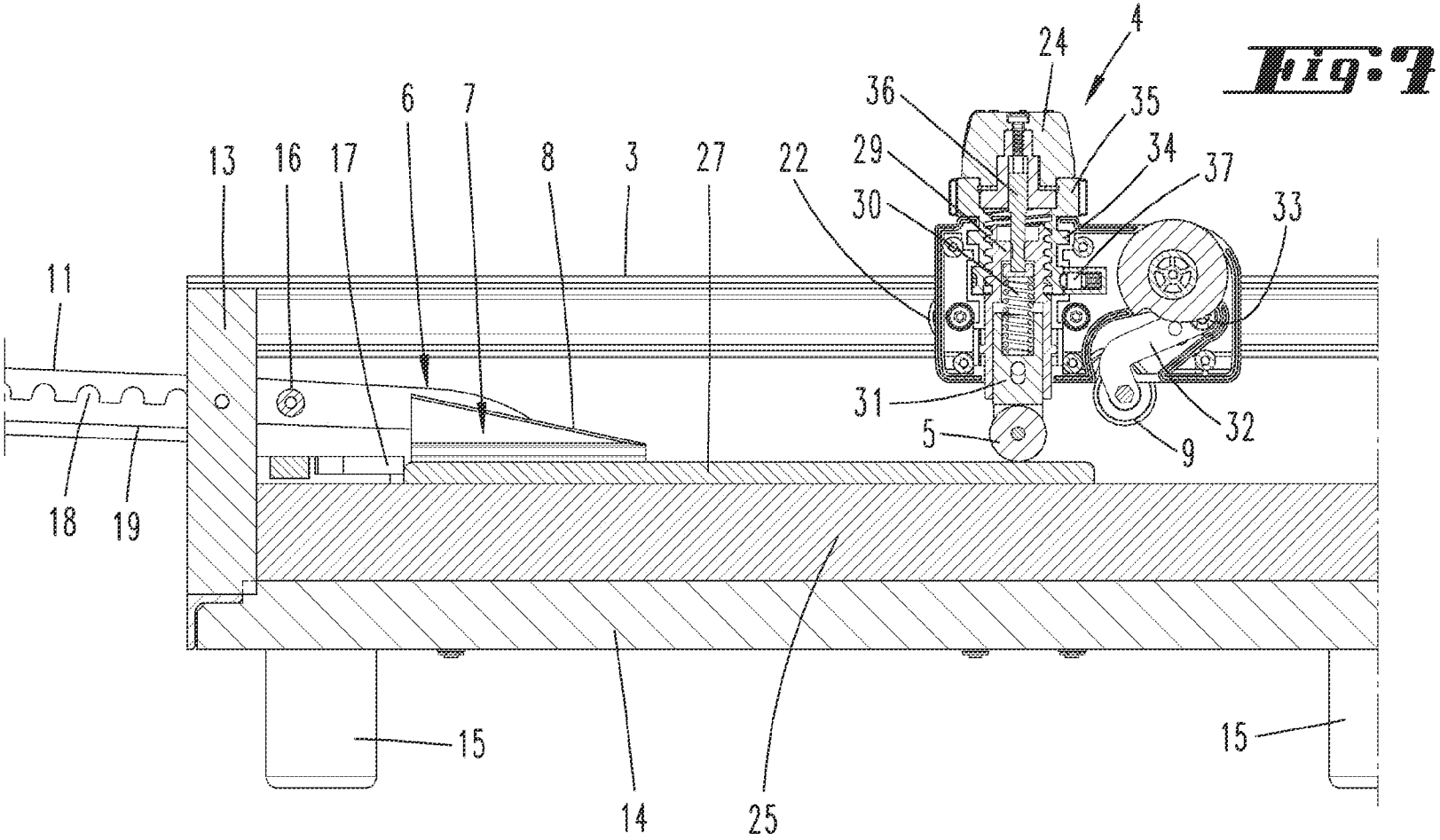
Figure 8:
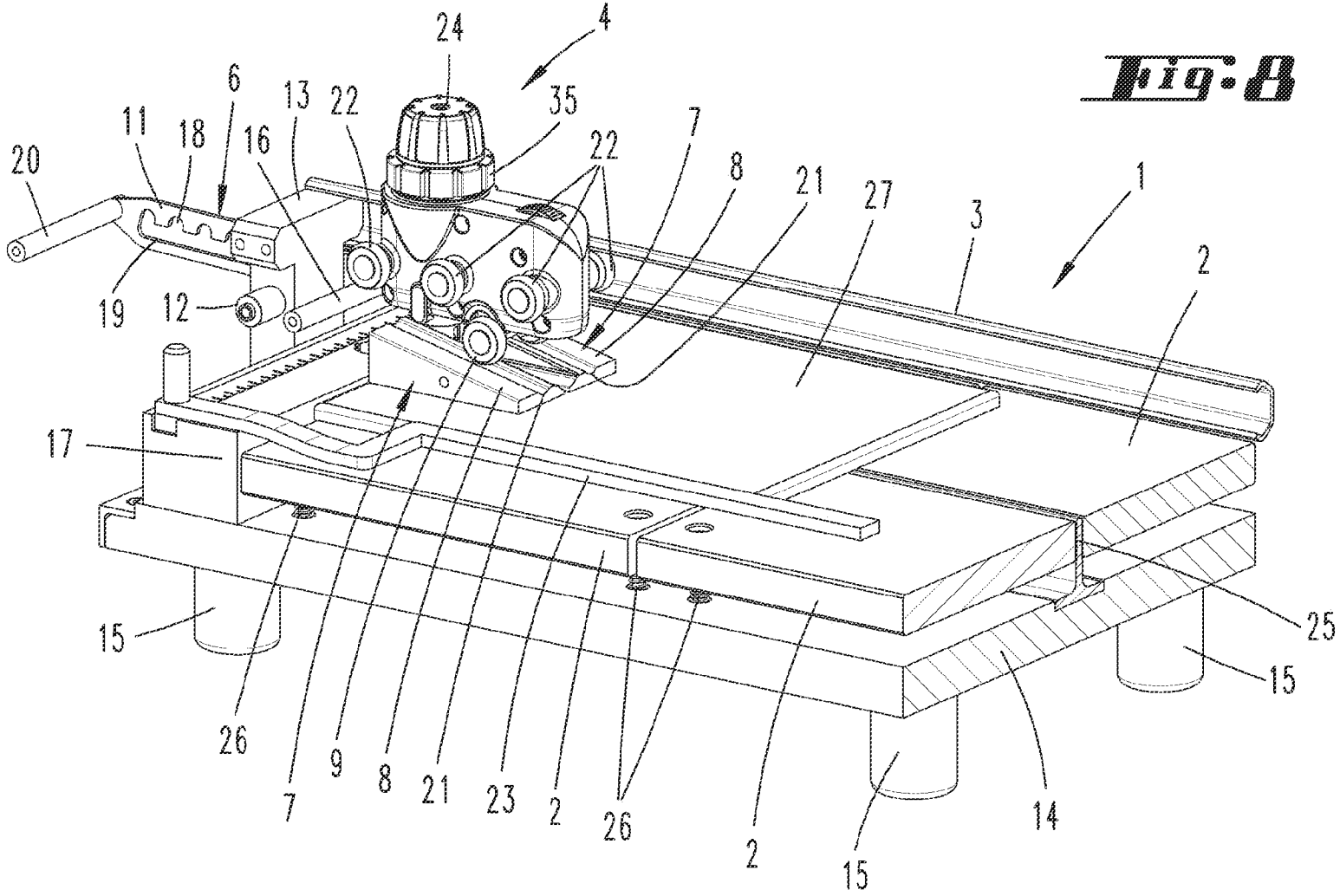
FIG. 8 shows an illustration according to FIG. 5, but with the slide 4 further displaced in the cutting direction.
Figure 9:
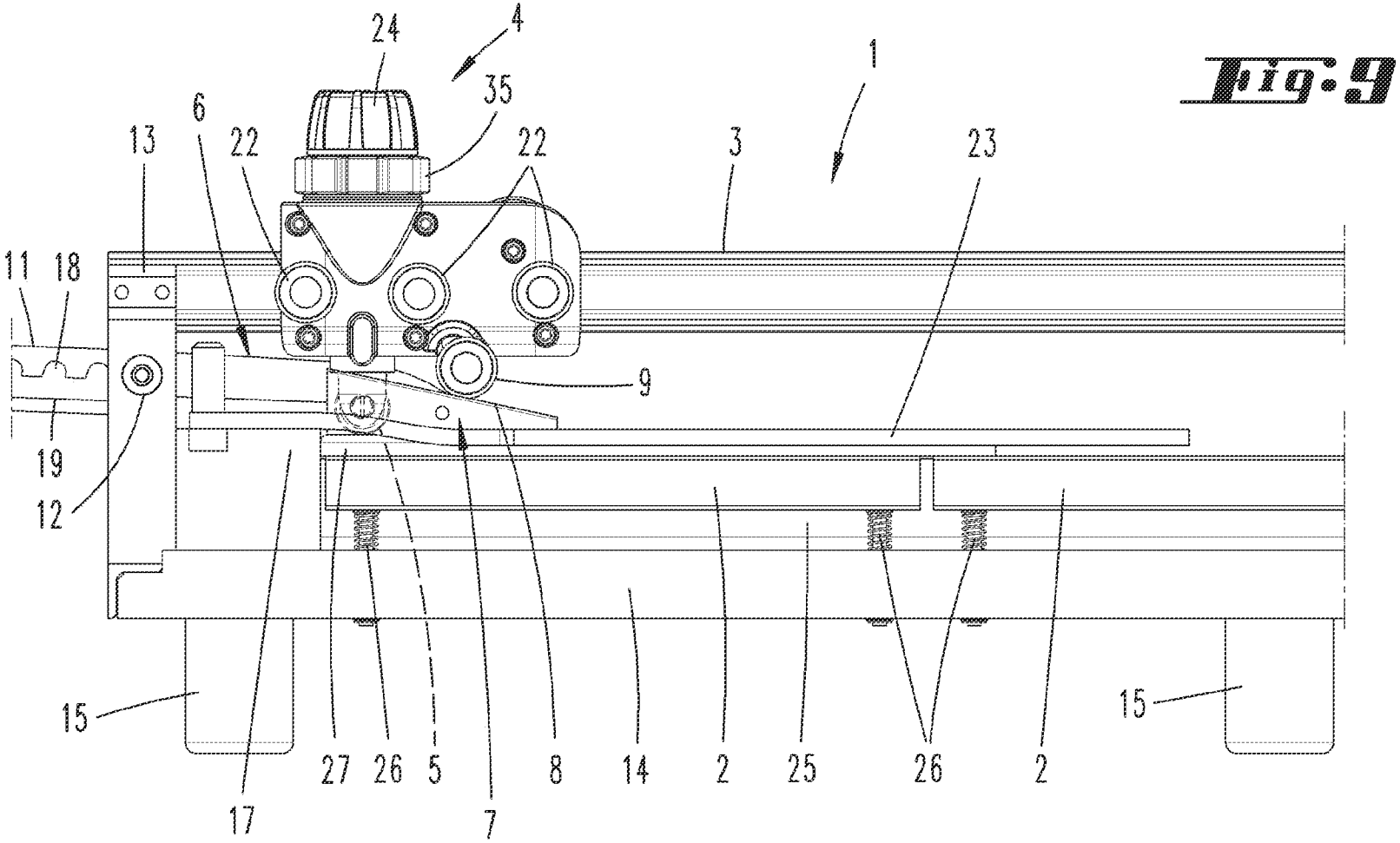
FIG. 9 shows an illustration according to FIG. 6, but in an operating position of the slide according to FIG. 8, in the end phase of the displacement of the slide.

The tile cutter illustrated in the drawings has a support plate 14 from which legs 15 protrude downwards, by means of which legs the base frame 1 can be set up on a floor. Above the support plate 14 there is a base plate 2. In the exemplary embodiment, the base plate 2 is a multi-part design. It is composed of a plurality of base plate portions, each of which is spring-loaded with respect the support plate 14. Through this, the individual base plate portions can be lowered towards the support plate 14. Through the force of the springs 26 which keep the base plate 2 spaced apart from the support plate 14, a cutting force can be applied by means of which a cutting tool 5 can cut a score into the surface of a tile resting on the base plate 2.

Two supports 13, which carry two U-shaped guide rails 3 that run parallel to one another, protrude from the base plate 2. The openings of the guide rails 3 face one another. Rollers 22 of a slide 4 run in the free space of the U of the guide rails 3. The slide 4 can be displaced along the guide rails 3 in the direction of extent of the guides 3.

The slide 4 has a housing including a downwardly protruding cutting tool 5 which is formed as a cutting wheel.

A head stop 17 against which a front edge of a tile 27 to be cut can be placed is located on the base plate 2.

Two control rollers 9 are located on the slide 4 which, with respect to the position of the stop 17, are disposed on the rear side of the cutting tool 5. The two rollers 9 are disposed offset laterally and in the cutting direction to the cutting wheel 5 and are secured to the end of a swing arm 32 which is mounted to be pivotable about an axis 33 in a cavity of the housing of the slide 4.

The swing arm 32 has a stop 39. This stop interacts with the eccentric outer circumferential surface of a height adjustment wheel 38. A region of the height adjustment wheel protrudes through an opening arranged on the upper side of the housing so that it can be turned. By turning the height adjustment wheel 38, the eccentric circumferential surface is brought into a different position with respect to the stop 39 so that the pivot angle of the swing arm 32 can be adjusted. Through this, the height position of the control member 9 can be adjusted and adapted to tiles that are differently thick.

A breaking rib 25 runs along the base plate 2 in the direction of extent of the two guide rails 3. The breaking rib 25 runs below the cutting wheel 5 and is formed by a T-shaped body which is secured to the support plate 14.

The preload of a spring 30 that acts with one end on a holding shank 31 at the end of which the cutting tool 5 is located can be adjusted by means of an adjusting wheel 24. The other end of the spring is supported on a plunger 36, the axial position of which can be adjusted by means of the adjusting wheel 24.

A height adjustment ring 35 is provided, which forms an internally threaded sleeve 34. A threaded shank 29 is inserted in the internal thread of the sleeve 34. By turning the height adjustment ring 35, the threaded shank 29 can be displaced in the axial direction so as to adjust the height position of the cutting tool 5. The turning position of the height adjustment ring 35 and/or the threaded sleeve 34, which is mounted axially fixed in the housing of the slide 4, is secured with a locking pin 37.

The support 13 which is locally associated with the head stop 17 forms a pivot pin 12 which supports a breaker jaw device 6. The breaker jaw device 6 has two lever arms 11 which are spaced apart from one another and which can be pivoted about the pivot pin 12. The two lever arms 11 are connected to one another by means of crossbars 20, 16 in such a manner that they run parallel to one another.

Each of the lever arms 11 carries at its free end a wedge-shaped breaker jaw 7. The breaker jaws 7 have a bottom side facing the base plate 2 by means of which the breaker jaws rest on a tile 27 to be cut. The breaker jaw device 6 can be mounted such that pivoting about the pivot pin 12 is tight so that the breaker jaw device can remain in different pivot positions due to the bearing friction.

The bottom side of the breaker jaws 7 is opposed by an obliquely extending control chamfer 8. Thus, the breaker jaws 7 have a wedge shape. On the surface of each of the two breaker jaws 7 there is also a groove 21 through which the control roller 9 can roll.

The two breaker jaws 7 are spaced apart from one another so that a gap 10 remains between the breaker jaws 7. The gap 10 has a gap width that is large enough that the cutting wheel 5 can pass through the gap 10. Moreover, a handle portion 28 by means of which the breaker jaw device 6 can be lifted protrudes from the free end of the lever arm 11.

The distance of the breaker jaws 7 from the stop 17 and/or the pivot pin 12 can be adjusted. For this purpose, each of the two lever arms 11 has a longitudinal slot 19 from which a plurality of locking recesses 18 protrude. The locking recesses 18 have different distances from the breaker jaws 7. The pivot pin 12 can selectively be put into one of the many locking recesses 18 so that the respective locking recess 18 forms a bearing recess. Through this, the distance of the breaker jaw 7 varies with respect to the stop 17 and/or the pivot pin 12.

The crossbars 16, 20 connect the two lever arms 11 to one another in such a manner that a frame is created that is rectangular in plan view. The support 13 is inserted in the frame so that the breaker jaw device 6 is captively connected to the base frame 11.

A lateral stop which is adjustable transverse to the direction of extent of the guide 3 is designated by the reference number 23.

The operating mode of the tile cutter is the following: If a tile is to be cut perpendicular to an outer edge, this outer edge is placed against the head stop 17. The breaker jaw device 6 is brought into such a position that the two breaker jaws 7 rest directly against the stop 17. At the same time, the breaker jaws 7 are situated in the region of the outer edge of the tile 27 to be cut.

Then, the slide 4 is displaced from a position remote from the stop 17 towards the stop 17, wherein the cutting wheel 5 runs onto an outer edge of the tile 27 and scores a score into the surface of the tile 27 while running over said surface. When the cutting tool 5 reaches the two breaker jaws 7, it runs through the gap 10 until it is run over the outer edge of the tile that rests against the stop 17. Approximately at the same time or slightly delayed, the two rollers 9, which are spaced apart from one another, each run against the control chamfers 8 and/or into the grooves 21 associated with them. During further displacement of the slide 4 towards the stop 17, the breaker jaws are pushed downwards so that the tile 27 resting on the breaking rib 25 breaks along the score. In doing so, the control member 9 runs onto the control flank 8 of the breaker jaw 7. Thereby, the swing arm 32 pivots slightly until the stop 39 thereof abuts against the eccentric curve of the height adjustment wheel 38. With the aid of the height adjustment wheel, the height of the roller 9 is first brought into such a position that the breaker jaws come into effect only after the score is produced completely.

Figure 10:
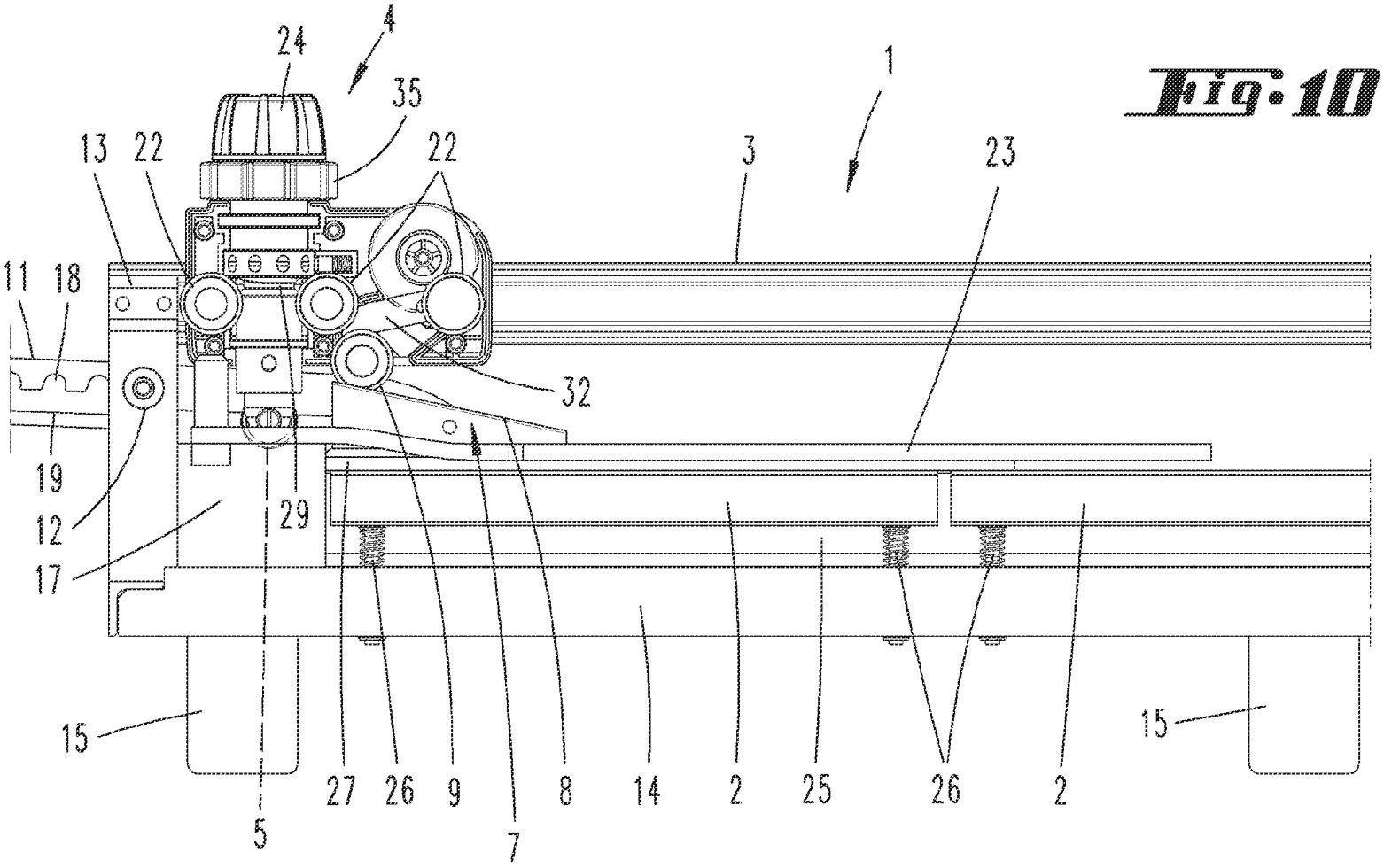
FIG. 10 shows a subsequent illustration of FIG. 9, with the breaker jaw device lowered.

As soon as the swing arm 32 abuts against the eccentric surface, the roller exerts a downwardly directed vertical force which is transmitted via the breaker jaw 7 to the tile 27 which is supported on the breaking rib 25. In the end phase of the displacement movement (see FIG. 10), the tile 27 breaks along the score.

Figure 11:
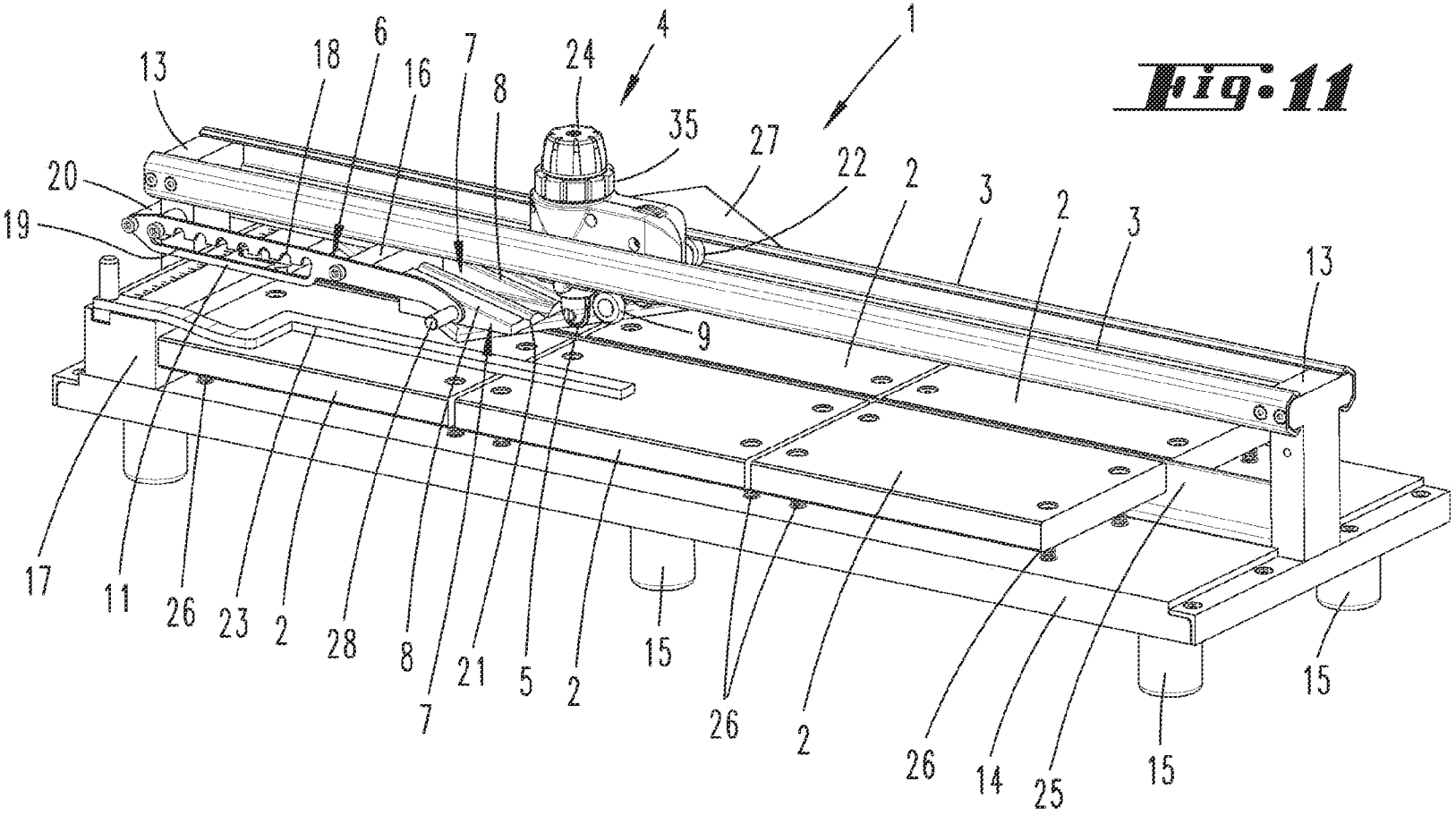
FIG. 11 shows an illustration according to FIG. 1, but with a position of the breaker jaw device 6 for cutting a diagonal cut.
Figure 12:
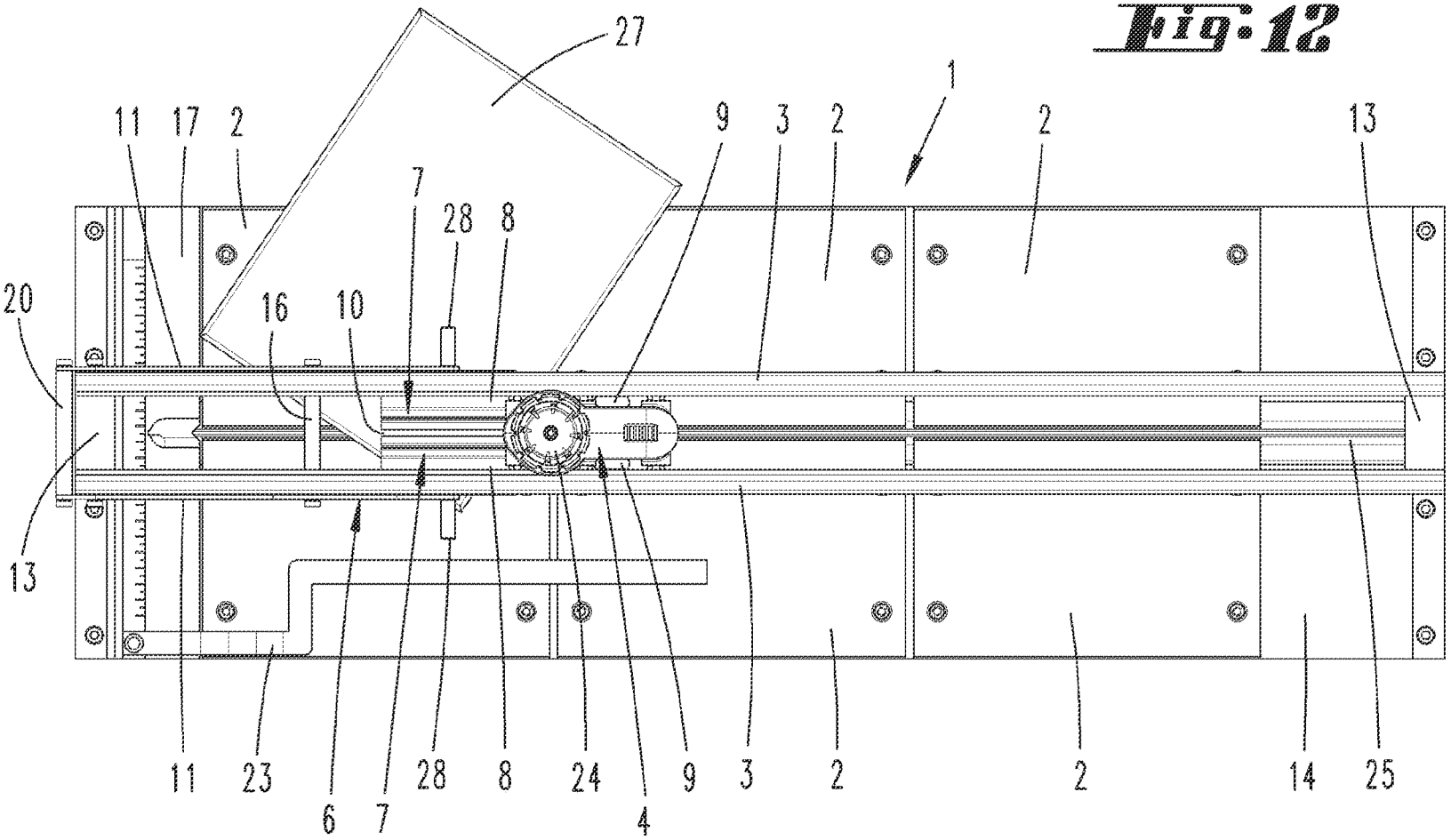
FIG. 12 shows a plan view of the tile cutter in the operating position illustrated in FIG. 11.

However, if a diagonal cut is to be produced, the tile is disposed accordingly on the base plate 2 (see FIGS. 11 and 12). The cut end is now at a distance from the stop 17. Thus, the breaker jaw device 6 is brought into a different operating position in which the jaws 7 are at a distance from the stop 17 which is selected such that the control rollers 9 exert a breaking force onto the breaker jaws 7 only after the cutting tool 5 has completed the score, thus has run over the outer edge of the tile 27 facing towards the stop 17.

The above embodiments serve for explanation of the inventions, overall comprised by the patent application, which improve the prior art at least through the following feature combinations in each case independently, namely:

A tile cutter, which is characterized in that the breaker jaw device 6 and the slide 4 interact with one another via a control flank arrangement in order to lower the breaker jaw device 6.

A tile cutter, which is characterized in that the control flank arrangement 8, 9 has a control member 9 that interacts with the control flank 8.

A tile cutter, which is characterized in that the control flank 8 is a control chamfer along which the control member 9 moves, which is in particular a pair of rollers.

A tile cutter, which is characterized in that the breaker jaw device 6 has two breaker jaws 7 which are secured to the base frame 1 so as to be movable substantially transverse to the displacement direction of the slide 4, the breaker jaws 7 being located in particular on a lever arrangement 11, 12 that is pivotably secured to the base frame 1.

A tile cutter, which is characterized in that each of the breaker jaws 7 is located at the end of a lever 12 of the lever arrangement.

A tile cutter, which is characterized in that the lever arrangement 11, 12 is length-adjustable, in particular a portion of the pivot pin 12 engaging in a longitudinal slot of a lever arm 11 which has a multiplicity of locking recesses 18 for mounting the lever arm 11 in differently spaced positions of the breaker jaws 7 with respect to the pivot pin 12.

A tile cutter, which is characterized in that the breaker jaws 7 are spaced apart from one another by a gap 10 through which the cutting tool 5 passes, which cutting tool is disposed upstream of the control member 9 in the displacement direction of the slide 4.

A cutting tile, which is characterized in that the guide 3 is carried by a support 13 which carries a pivot pin 12 around which a lever arm 11 is pivotably mounted, which lever arm carries a breaker jaw 7 at its end.

A tile cutter, which is characterized in that the breaker jaw 7 has a wedge shape.

A tile cutter, which is characterized in that, viewed in the cutting direction, at least one control member 9 is disposed downstream of the cutting tool 5 on the slide 4.

A tile cutter, which is characterized in that each of the two breaker jaws 7 is pivotably secured to the support 13 with a lever arm 11, the two lever arms 11 in particular being connected to one another by means of a crossbar 16, 20.

A tile cutter, which is characterized in that the guide 3 has two rails that run parallel to one another and that the levers 11 of the lever arrangement extend substantially parallel to the guide 3.

All features disclosed are (in themselves but also in combination with one another) pertinent to the invention. The disclosure content of the associated/accompanying priority documents (copy of the prior application) is also hereby included in full in the disclosure of the application, including for the purpose of incorporating features of these documents in claims of the present application. The subsidiary claims with their features characterize independent inventive refinement of the prior art, in particular to undertake divisional applications based on these claims.

REFERENCE LIST 1 base frame
2 base plate
3 guide
4 slide
5 cutting tool
6 breaker jaw device
7 breaker jaw
8 control flank
9 control member
10 gap
11 lever arrangement
12 lever arrangement
13 support
14 support plate
15 leg
16 crossbar
17 stop
18 locking recess
19 slot
20 crossbar
21 groove
22 roller
23 lateral stop
24 adjustment wheel
25 breaking rib
26 spring
27 tile
28 handle
29 threaded shank
30 spring
31 holding shank
32 swing arm
33 axis
34 internally threaded sleeve
35 height adjustment ring
36 plunger
37 locking pin
38 height adjustment wheel
39 stop

The invention claimed is:

1. A tile cutter, comprising: a base frame with a base plate and a guide which is disposed above the base plate; and a slide carrying a cutting tool, the slide being displaceable along the guide in order to produce a score on a surface of a tile resting on the base plate; and a breaker jaw device gear-coupled to the slide and lowerable onto the surface of the tile in an end phase of the displacement of the slide in order to break the tile along the score, wherein the breaker jaw device and the slide interact with one another via a control flank arrangement in order to lower the breaker jaw device, wherein the control flank arrangement is a control chamfer along which a control member moves, the control member being part of the slide.

2. The tile cutter according to claim 1, wherein the control member includes a pair of rollers.

3. The tile cutter according to claim 1, wherein the breaker jaw device has two breaker jaws that are secured to the base frame so as to be movable, the breaker jaws being located on a lever arrangement that is pivotably secured to the base frame.

4. The tile cutter according to claim 3, wherein the breaker jaws are located in each case at an end of a lever of the lever arrangement.

5. The tile cutter according to claim 4, wherein the lever arrangement is length-adjustable and includes a pivot pin and a lever arm, a portion of the pivot pin engages in a longitudinal slot of the lever arm that has a plurality of locking recesses for mounting the lever arm in differently spaced positions of the breaker jaws with respect to the pivot pin.

6. The tile cutter according to claim 3, wherein the breaker jaws are spaced apart from one another by a gap through which the cutting tool passes, the cutting tool being disposed upstream of the control member in the displacement direction of the slide.

7. The tile cutter according to claim 1, wherein the guide is carried by a support that carries a pivot pin around which a lever arm is pivotably mounted, which lever arm has an end that carries a breaker jaw.

8. The tile cutter according to claim 3, wherein the breaker jaws have a wedge shape.

9. The tile cutter according to claim 2, wherein, viewed in a cutting direction, the control member is disposed downstream of the cutting tool on the slide.

10. The tile cutter according to claim 3, wherein the guide is carried by a support, each of the two breaker jaws being pivotably secured to the support with a lever arm, the two lever arms being connected to one another by a crossbar.

11. The tile cutter according to claim 3, wherein the guide has two rails running parallel to one another, the lever arrangement having levers that extend substantially parallel to the guide.

* * * * *